US011383917B2

(12) United States Patent
Tsubouchi et al.

(10) Patent No.: US 11,383,917 B2
(45) Date of Patent: Jul. 12, 2022

(54) AEROSOL PRODUCT

(71) Applicant: Toyo Aerosol Industry Co., Ltd., Tokyo (JP)

(72) Inventors: Makoto Tsubouchi, Tokyo (JP); Ken Ogata, Tokyo (JP); Shohei Ishida, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 17/008,959

(22) Filed: Sep. 1, 2020

(65) Prior Publication Data

US 2020/0391933 A1 Dec. 17, 2020

Related U.S. Application Data

(63) Continuation of application No. PCT/JP2018/009128, filed on Mar. 9, 2018.

(51) Int. Cl.
*B65D 83/68* (2006.01)
*B65D 81/32* (2006.01)
(Continued)

(52) U.S. Cl.
CPC ..... *B65D 83/682* (2013.01); *B65D 81/32* (2013.01); *B65D 81/3233* (2013.01);
(Continued)

(58) Field of Classification Search
CPC .. B65D 83/682; B65D 81/3233; B65D 83/32; B65D 83/62; B65D 83/752; B65D 83/685; B65D 81/32
See application file for complete search history.

(56) References Cited

U.S. PATENT DOCUMENTS 4,531,659 A * 7/1985 Wright ..... A45D 27/10 222/190
4,901,925 A * 2/1990 Blake, III ..... B05B 7/0037 222/190
(Continued)

FOREIGN PATENT DOCUMENTS

JP H06-336272 A 12/1994
JP 2003-300570 A 10/2003
(Continued)

OTHER PUBLICATIONS

Office Action dated May 11, 2021, issued in counterpart JP Application No. 2020-504608, with English translation. (6 pages).
(Continued)

*Primary Examiner* — Frederick C Nicolas
(74) *Attorney, Agent, or Firm* — WHDA, LLP

(57) ABSTRACT

Provided is an aerosol product which has a simple configuration and which makes it possible to emulsify a foamable liquid and a foaming agent sufficiently and discharge a satisfactory foam without shaking the aerosol container. An aerosol product (100) has a plurality of partitioned housing spaces and a valve unit (120) provided with an inflow port (122) corresponding to the housing space, wherein at least one among the plurality of housing spaces is a foamable liquid housing section (141) that houses contents (S) including a foamable liquid, at least one other of the plurality of housing spaces is a foaming agent housing section (140) that houses contents including a foaming agent (LG), and the foamable liquid (S) discharged from the inflow port (122) and the foaming agent (LG) discharged from the inflow port (122A) are mixed in an actuator (130).

4 Claims, 2 Drawing Sheets

(51) Int. Cl.

| | |
|---|---|
| ***B65D 83/14*** | (2006.01) |
| ***B65D 83/62*** | (2006.01) |
| *B65D 83/32* | (2006.01) |

(52) U.S. Cl.
CPC ..... *B65D 83/62* (2013.01); *B65D 83/685* (2013.01); *B65D 83/752* (2013.01); *B65D 83/32* (2013.01)

(56) References Cited

U.S. PATENT DOCUMENTS

| | | | | |
|---|---|---|---|---|
| 2006/0054634 | A1* | 3/2006 | Mekata | B65D 83/40 222/94 |
| 2013/0284759 | A1 | 10/2013 | Teramoto | |
| 2014/0008389 | A1* | 1/2014 | Mekata | B65D 83/20 222/94 |
| 2015/0166253 | A1* | 6/2015 | Nomura | B65B 3/00 222/402.1 |
| 2018/0049955 | A1* | 2/2018 | Nakajima | A61K 8/731 |
| 2021/0002064 | A1* | 1/2021 | Tsubouchi | B65D 83/752 |

FOREIGN PATENT DOCUMENTS

| | | | |
|---|---|---|---|
| JP | 2012-224376 | A | 11/2012 |
| JP | 2013-079082 | A | 5/2013 |
| JP | 2013-082478 | A | 5/2013 |
| JP | 2015-163658 | A | 9/2015 |
| JP | 2016-216131 | A | 12/2016 |
| WO | 2012/057342 | A1 | 5/2012 |

OTHER PUBLICATIONS

International Search Report dated Apr. 17, 2018, issued in counterpart International Application No. PCT/JP2018/009128 (1 page).
Office Action dated Feb. 2, 2021, issued in counterpart JP Application No. 2020-504608, with English Translation. (8 pages).
Extended European Search Report dated Feb. 17, 2021, issued in counterpart EP Application No. 18908338 9. (8 pages).

* cited by examiner

AEROSOL PRODUCT

TECHNICAL FIELD

The present invention relates to an aerosol product having a valve unit having a stem protruding from an aerosol container, and an actuator fitted to the stem, and more particularly to an aerosol product suitable for discharging the contents in the form of a foam.

BACKGROUND ART

Aerosol products having a valve unit having a stem protruding from an aerosol container, and an actuator fitted to the stem are well known, and those which discharge the contents in the container from the actuator in the form of a foam are also well known.

For example, Patent Literature 1 discloses an aerosol product (foamable aerosol product 10) having a pressure-resistant aerosol container (outer container 11), a housing space (inner container 12) that is housed in the aerosol container (outer container 11) and has a partition wall having a variable volume, a valve unit (aerosol valve 13) communicating with the housing space (inner container 12), a foamable composition filled in the housing space (inner container 12) and composed of a foamable liquid (aqueous stock solution) and a foaming agent (lipophilic liquefied gas), and a pressurizing agent B filled in a pressurizing chamber S between the housing space (inner container 12) and the aerosol container (outer container 11).

In this aerosol product (foamable aerosol product 10), the pressure of the pressurizing agent B is set to be equal to or less than the pressure of the foamable composition and higher than the atmospheric pressure, so that a gas phase is contained in the housing space (inner container 12). By shaking the aerosol container (outer container 11) up and down, it is possible to emulsify the foamable composition and form a uniform foamable liquid (aqueous stock solution) and a dispersed phase of a foaming agent (lipophilic liquefied gas), and to discharge a stable foam.

In addition, the gas-phase portion in the housing space (inner container 12) communicates with the atmosphere during use, and a portion of the gas in the gas-phase portion in the housing space (inner container 12) may escape to the atmosphere immediately after use. However, at the same time, the pressure in the housing space (inner container 12) decreases, so that the housing space (inner container 12) is contracted by the pressure of the pressurizing agent B to assume an almost liquid-tight state. Thus, even if the aerosol product (foamable aerosol product 10) is discharged in an upright state or an inverted state, the liquid-phase portion in the storage space (inner container 12) can be reliably discharged.

Furthermore, it is also possible to accommodate two housing spaces (inner containers 12) in one aerosol container (outer container 11), and an aerosol product (foamable aerosol product 10) enabling the discharge of two foamable compositions as a foam simultaneously or separately can also be provided in a compact size.

CITATION LIST

Patent Literature

Patent Literature 1: Japanese Patent Application Publication No. 2012-224376

SUMMARY OF INVENTION

Technical Problem

However, there is still room for improvement in the known aerosol products disclosed in Patent Literature 1.

That is, when the foamable liquid and the foaming agent have been present separately in the same inner container in the stationary state of the aerosol product, it is necessary to shake and emulsify the aerosol product before use. This takes time, and also where the aerosol product is shaken and then allowed to stand without discharging, the foam may fill the gas-phase portion in the inner container depending on the nature of the foamable liquid, and where defoaming is not completed before the next use, the foamable liquid and the foaming agent may not be sufficiently emulsified even if the aerosol product is shaken again.

In addition, depending on the type of the foamable liquid, deterioration and a change in properties may be advanced by contact with the foaming agent. Therefore, both the foamable liquid and the foaming agent sometimes cannot be put in one inner container.

The present invention solves these problems, and it is an object thereof to provide an aerosol product which has a simple configuration, in which a foamable liquid and a foaming agent are not in contact with each other inside an aerosol container during storage, and which makes it possible to emulsify the foamable liquid and the foaming agent sufficiently and discharge a satisfactory foam without shaking the aerosol container.

Solution to Problem

The aerosol product of the present invention has a valve unit having a stem protruding from an aerosol container, and an actuator fitted to the stem, wherein the aerosol container includes a plurality of partitioned housing spaces, an inflow port corresponding to the housing space, and one or more valve units in which a sealing member opening and closing the inflow port is provided for each inflow port; at least one among the plurality of housing spaces is a foamable liquid housing section that houses contents including a foamable liquid; at least one other of the plurality of housing spaces is a foaming agent housing section that houses contents including a foaming agent; and the foamable liquid discharged from the inflow port corresponding to the foamable liquid housing section and the foaming agent discharged from the inflow port corresponding to the foaming agent housing section are mixed in the actuator, thereby resolving the aforementioned problem.

Advantageous Effects of Invention

According to the aerosol product of the invention according to claim 1, the aerosol container includes a plurality of partitioned housing spaces, an inflow port corresponding to the housing space, and one or more valve units in which a sealing member opening and closing the inflow port is provided for each inflow port, at least one among the plurality of housing spaces is a foamable liquid housing section that houses contents including a foamable liquid, at least one other of the plurality of housing spaces is a foaming agent housing section that houses contents including a foaming agent, and the foamable liquid discharged from the inflow port corresponding to the foamable liquid housing section and the foaming agent discharged from the inflow port corresponding to the foaming agent housing section are mixed in the actuator. Therefore, even if the foamable liquid and the foaming agent react with each other and deteriorate when mixed together, they can be stored in a state of insulation from each other until immediately before use.

Furthermore, since the foamable liquid and the foaming agent are mixed in the actuator, they can be discharged in the form of a foam without shaking the container immediately before use.

According to the configuration set forth in claim 2, the inflow port corresponding to the foaming agent housing section is configured to eject a liquid phase of the foaming agent from the foaming agent housing section. Therefore, the liquid phase of the foaming agent and the foamable liquid can be reliably mixed in the actuator and can be discharged in the form of a foam, without discharging the gas phase of the foaming agent.

According to the configuration set forth in claim 3, the aerosol container has one container and one or more foamable liquid housing sections housed in the container, and the foaming agent housing section is configured by a space outside the foamable liquid housing section in the container. Therefore, the foamable liquid housing section can be compressed and discharged by the pressure of the gas phase of the foaming agent, and it is not necessary to prepare a discharge gas in addition to the foaming agent.

According to the configuration set forth in claim 4, the actuator has a fitting portion fitted to the stem, a mixing section where materials discharged from the inflow ports are mixed, and a discharge port for discharging the mixed discharged materials, and the foamable liquid and the foaming agent are merged and mixed for the first time in the actuator connected to the valve unit. Therefore, even if the residual liquid of the foamable liquid and the foaming agent mixed in the actuator is fixedly attached therein, satisfactory discharge in the form of a foam can be maintained by simply replacing with a new actuator or by washing.

Further, the state of the foam to be discharged can be changed by replacing with an actuator of a different shape.

REFERENCE SIGNS LIST

Figure 1:
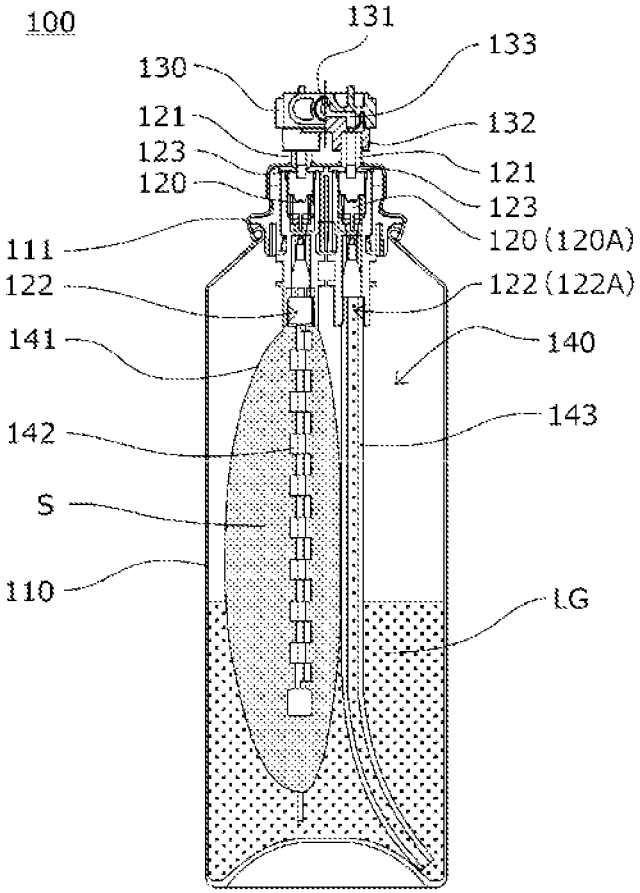
FIG. 1 is a cross-sectional view of an aerosol product 100 according to one embodiment of the present invention.

100, 200 Aerosol product
110, 210 Aerosol container
111, 211 Mounting cup
120, 220 Valve unit
120A, 220A Liquid phase valve unit
121, 221 Stem
122, 222 Inflow port
122A, 222A Liquid phase inflow port
123, 223 Sealing member
130, 230 Actuator
131, 231 Discharge port
132, 232 Fitting portion
133, 233 Discharge flow path
140 Foaming agent housing section
240 Propellant housing section
241 Foaming agent housing section
141, 242 Foamable liquid housing section
142, 243 Residual quantity reduction member
143 Dip tube
LG Foaming agent
S Content
B Propellant

DESCRIPTION OF EMBODIMENTS

Hereinafter, an aerosol product 100 according to an embodiment of the present invention will be described with reference to the drawings.

Here, specific uses of the foamable liquid of the present invention include a face wash, a cleansing agent, a shaving agent, a hair restorer, a hand soap, a styling agent, and the like. Examples of the respective compositions are shown in Tables 1 to 6.

The application and composition of the foamable liquid that can be used in the present invention are not limited to these examples.

TABLE 1

Face wash

| Components | Content ratio (wt %) |
|---|---|
| Sodiumlauroylglutamate | 20 |
| Glycerin | 5 |
| Xantangum | 0.1 |
| Citricacid | 0.075 |
| EDTA-2Na | 0.05 |
| CocamideDEA | 5 |
| Decylglucoside | 5 |
| Polyquaternium-39 | 3 |
| Phenoxyethanol | 0.3 |
| Water | Balance |
| Total | 100 |

TABLE 2

Cleansing agent

| Components | Content ratio (wt %) |
|---|---|
| IsostearicacidPEG-10BG | 10 |
| Isopropylmyristate | 12 |
| Dimethicone | 2 |
| Decylglucoside | 2 |
| Laurylglucoside | 2 |
| Phenoxyethanol | 0.3 |
| Glycerin | 5 |
| BG | 1 |
| Ethanol | 1 |
| Water | Balance |
| Total | 100 |

TABLE 3

Shaving agent

| Components | Content ratio (wt %) |
|---|---|
| Stearicacid | 5 |
| Palmiticacid | 3.5 |
| POEsorbitantristearate (20 E.O.) | 1 |
| POEsorbitanmonolaurate (20 E.O.) | 1 |
| POEsorbitanmonooleate (20 E.O.) | 1 |
| Triethanolamine | 3 |

TABLE 3-continued

| Shaving agent | |
|---|---|
| Components | Content ratio (wt %) |
| 48% Aqueous solution of potassiumhydroxide | 1 |
| Phenoxyethanol | 0.3 |
| Water | Balance |
| Total | 100 |

TABLE 4

| Hair restorer | |
|---|---|
| Components | Content ratio (wt %) |
| Ethanol | 20 |
| Dipotassiumglycyrrhizate | 0.1 |
| Swertia japonica extract | 0.3 |
| Menthol | 0.2 |
| POEsorbitanisostearate (20 E.O.) | 0.75 |
| Isopropylmyristate | 0.5 |
| Phenoxyethanol | 0.3 |
| Water | Balance |
| Total | 100 |

TABLE 5

| Hand soap | |
|---|---|
| Components | Content ratio (wt %) |
| Sodiumlaurylsulfate | 20 |
| Sodiumcocoamphoacetate | 10 |
| Glycerin | 5 |
| Dipropyleneglycol | 3 |
| Methylparaben | 0.2 |
| Water | Balance |
| Total | 100 |

TABLE 6

| Styling agent | |
|---|---|
| Components | Content ratio (wt %) |
| Ethanol | 10 |
| (Acrylate/diacetoneacrylamide) copolymerAMP | 15 |
| Cetrimoniumchloride | 0.25 |
| POEsorbitanmonostearate | 0.25 |
| Phenoxyethanol | 0.3 |
| Water | Balance |
| Total | 100 |

As shown in FIG. 1, an aerosol product 100 is a so-called dual valve type product in which two valve units 120 are fixed to the mouth of an aerosol container 110 with a mounting cup 111 and two stems 121 project upward.

The housing space in the aerosol container 110 is divided into two housing spaces: a foamable liquid housing section 141 having flexibility, and a foaming agent housing section 140 outside the foamable liquid housing section 141.

Contents S including the foamable liquid are tightly housed inside the foamable liquid housing section 141, and a foaming agent LG is housed in the foaming agent housing section 140.

An inflow port 122 communicating between the inside and the outside of the valve unit 120 is provided at the lower part of the valve unit 120, one of the two valve units 120 is connected to the inflow port 122 so that the contents S inside the foamable liquid housing section 141 are discharged therein, and the other valve unit 120A (hereinafter, referred to as "liquid phase valve unit 120A") is configured so that a hollow dip tube 143 is connected to the inflow port 122, and the liquid-phase portion of the foaming agent LG housed inside the foaming agent housing section 140 is discharged.

Stems 121 projecting upward from the two valve units 120 each have a sealing member 123, an actuator 130 is attached to the stems 121 through a fitting portion 132, and a discharge flow path 133 provided in the actuator 130 is configured to allow the two stems 121 to communicate with each other, to allow the contents S and the foaming agent LG to merge, and then to be able to discharge the two from a discharge port 131.

Described hereinbelow is the foam-shaped discharge of the contents S and the foaming agent LG by the aerosol product 100.

First, by pressing the actuator 130 downward, the blockage between the inflow ports 122 and the flow paths in the stems 121 by the sealing members 123 is released, the valve unit 120 and the liquid phase valve unit 120A are opened, the liquid-phase portion of the foaming agent LG is discharged from the stem 121 through the dip tube 143 by the pressure of the gas-phase portion of the foaming agent LG housed in the foaming agent housing section 140, the foamable liquid housing section 141 is also subjected to pressure, and the contents S is discharged from the stem 121.

The foaming agent LG and the contents S merge in the discharge flow path 133 in the actuator 130.

At this time, the foaming agent LG and the contents S are violently collided and mixed with each other in the discharge flow path 133 by the force of the pressure of the gas-phase portion of the foaming agent LG.

Thereby, the contents S and the foaming agent LG can be emulsified without shaking the aerosol container 110.

Further, since the foaming agent LG gradually vaporizes and expands in an emulsified state to form countless fine bubbles, the contents S can be discharged in the form of a foam from the discharge port 131 of the actuator 130.

In the present embodiment, a residual quantity reduction member 142 is attached to the inflow port 122 in the foamable liquid housing section 141 and is configured to stabilize the discharge amount of the contents S and reduce the residual quantity until the end.

Further, since the contents S are discharged by the pressure received by the foamable liquid housing section 141 from the foaming agent housing section 140, the contents S and the foaming agent LG do not come into contact with each other during storage, and there is no need to mix a material such that applies pressure to the contents S.

Furthermore, when the foaming agent LG is made to have a low pressure and the foaming agent housing section 140 is filled with a compressed gas as a propellant together with the foaming agent LG, a rapid rise in pressure can be suppressed even in a high-temperature state, as compared with the case where the foaming agent LG is also used as a propellant.

Further, since the contents S and the foaming agent LG can be stored in an isolated state by the foamable liquid housing section 141, even if the contents S and the foaming agent LG react with each other and deteriorate when mixed together, they can be stored without mixing with each other until immediately before use.

Further, since the contents S and the foaming agent LG merge for the first time in the actuator 130, even when the residual liquid of the contents S and the foaming agent LG after discharging is fixedly attached inside the actuator 130 and blocks the discharge flow path 133, a satisfactory discharge in the form of a foam can be maintained again by replacing or washing the actuator 130, and the state of the foam to be discharged can easily be changed by changing to the actuator 130 with a different shape of the discharge flow path 133.

Next, an aerosol product 200 according to another embodiment of the present invention will be described with reference to the drawings.

The description of members shared with the aerosol product 100 will be omitted.

Figure 2:
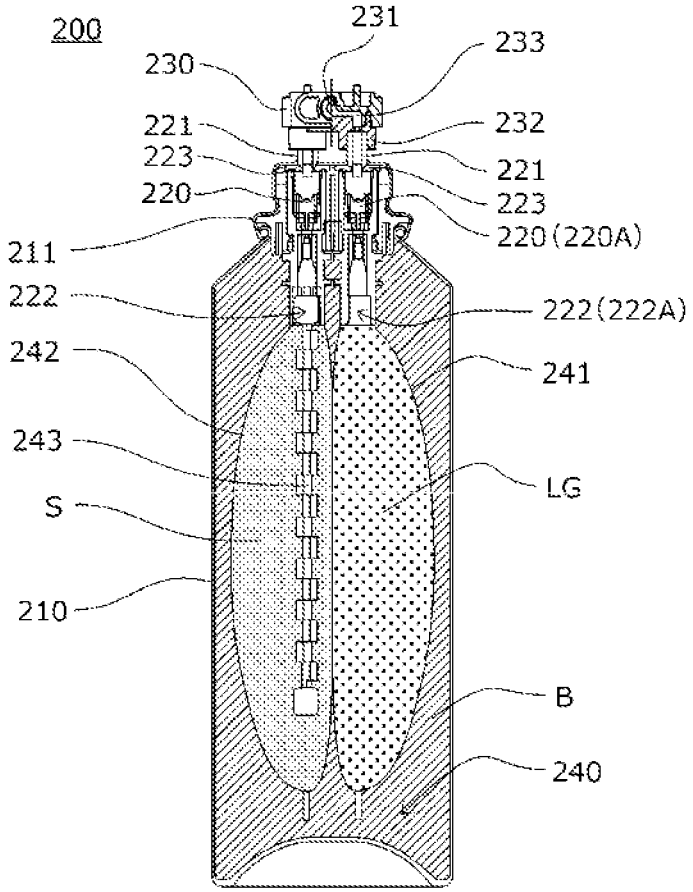
FIG. 2 is a cross-sectional view of an aerosol product 200 according to a variation example of one embodiment of the present invention.

In the aerosol product 200, as shown in FIG. 2, a foamable liquid housing section 242 having flexibility and a foaming agent housing section 241 having flexibility are provided in the housing space in an aerosol container 210, a propellant housing section 240 is further provided outside the foamable liquid housing section 242 and outside the foaming agent housing section 241, and the inside of the aerosol container 210 is partitioned into three housing spaces.

The contents S including the foamable liquid is tightly housed inside the foamable liquid housing section 242, and the foaming agent LG for foaming the foamable liquid is tightly housed inside the foaming agent housing section 241.

A propellant B that applies pressure to compress the foamable liquid housing section 242 and the foaming agent housing section 241 during discharge is housed in the propellant housing section 240.

Thus, the foaming agent LG in the foaming agent housing section 241 does not require pressure for discharging the contents S in the foamable liquid housing section 242, and the low-pressure foaming agent LG can be used. Since the propellant B in the propellant housing section 240 is housed so as to maintain a pressure sufficiently larger than that of the foaming agent LG, the foaming agent LG in the foaming agent housing section 241 substantially generates no gas-phase portion, and the inside of the foaming agent housing section 241 can be maintained in a liquid-tight state.

Depending on the pressure difference between the propellant B and the foaming agent LG, a gas phase may be generated in the foaming agent housing section 241, but in such a case, a dip tube or the like may be used to suck up the liquid-phase portion.

An inflow port 222 communicating between the inside and the outside of the valve unit 220 is provided at the lower part of the valve unit 220, and one of the two valve units 220 is connected so that the contents S inside the foamable liquid housing section 242 are discharged to the inflow port 222, and the other valve unit 220A (hereinafter, referred to as "liquid phase valve unit 220A") is configured to discharge the foaming agent LG housed in the foaming agent housing section 241 connected to the inflow port 222.

Described hereinbelow is how the contents S and the foaming agent LG are discharged in the form of a foam by the aerosol product 200.

First, by pressing the actuator 230 downward, the blockage between the inflow ports 222 and the flow paths in the stems 221 by the sealing members 223 is released, the valve unit 220 and the liquid phase valve unit 220A are opened, the pressure of the propellant B housed in the propellant housing section 240 is received by the foamable liquid housing section 242 and the foaming agent housing section 241, and the contents S and the liquid phase portion the foaming agent LG are discharged from the stems 221.

The foaming agent LG and the contents S merge in the discharge flow path 233 in the actuator 230.

At this time, the foaming agent LG and the contents S are violently collided and mixed with each other in the discharge flow path 233 by the force of the pressure of the gas-phase portion of the propellant B.

As a result, the contents S and the foaming agent LG can be emulsified without shaking the aerosol container 210.

Further, since the foaming agent LG gradually vaporizes and expands in an emulsified state to form countless fine bubbles, the contents S can be discharged in the form of a foam from the discharge port 231 of the actuator 230.

In the present embodiment, a residual quantity reduction member 243 is attached to the inflow port 222 in the foamable liquid housing section 242 and is configured to stabilize the discharge amount of the contents S and reduce the residual quantity until the end.

Further, where the propellant B is formed of a liquefied gas, even if the pressure of the gas-phase portion of the propellant B is reduced as a result of discharging the contents S and the foaming agent LG, the liquid-phase portion of the propellant B is vaporized to compensate the pressure of the propellant B, so that a decrease in the discharge pressure of the contents S and the foaming agent LG can be prevented.

When the foaming agent LG has a low pressure and the propellant B is composed of a compressed gas, a sharp increase in pressure can be suppressed even in a high temperature state, as compared with the case where a liquefied gas is used as the propellant.

Here, known liquefied gas and compressed gas which are generally used for aerosol products can be used as the types of gas to be used as the foaming agent and the propellant.

The types of liquefied gas to be used as the foaming agent and the propellant can be exemplified by propane, butane, pentane, or a liquefied petroleum gas including these, dimethylether, hydrofluoroolefins, hydrofluorocarbons, and the like, and the types of compressed gas to be used as the foaming agent and the propellant can be exemplified by nitrogen, carbondioxide, compressed air, oxygen, helium, nitrousoxide, and the like, and a mixture of a plurality of these types may be used.

The embodiments of the present invention have been described hereinabove in detail. However, the present invention is not limited to the above embodiments, and various design changes can be made without departing from the present invention set forth in the claims.

In the above-described embodiments, the description has been given assuming that the residual quantity reduction member is attached to the inflow port. However, this configuration in the foamable liquid housing section is not limiting. For example, it is possible to attach a dip tube so that a gap is formed in a part of the inflow port, without providing the residual quantity reduction member.

Further, in the above-described embodiment, the so-called dual valve type in which one aerosol container has two valve units has been described. However, the configuration of the present invention is not limited to this. For example, the number of valve units may be three or more, a plurality of aerosol containers having one valve unit may constitute a plurality of housing spaces, and one valve unit may be provided with a plurality of inflow ports and sealing members corresponding to respective inflow ports.

Further, in the above-described embodiment, the configuration is described in which the liquefied gas is discharged from the liquid phase valve unit, but the configuration for discharging from the liquid phase valve unit is not limited thereto. For example, a perfume component which is not separated from the liquefied gas may be mixed with the liquefied gas.

Further, in the above-described embodiment, the liquid phase valve unit is connected to the hollow dip tube, and is configured to discharge the liquid-phase portion of the liquefied gas contained in the foaming agent housing section. However, this method for discharging the liquefied gas is not limiting. For example, a configuration may be used in which the dip tube is not connected, the discharge may be performed in the inverted state of the aerosol container, a weight is attached to the tip of the dip tube formed of a flexible material, so that the tip of the dip tube is located below the liquid surface of the liquefied gas at all times, and the liquid phase of the liquefied gas is sucked up regardless of the orientation of the aerosol container.

In the above-described embodiments, the foaming agent and the contents are violently collided and mixed in the discharge flow path by the force of the pressure of the gas-phase portion of the foaming agent, whereby the contents and the foaming agent are emulsified without shaking the aerosol container, but such a relationship between the foaming agent and the contents is not limiting. For example, a combination in which the foaming agent dissolves in the contents may be used.

The invention claimed is:

1. An aerosol product having a valve unit having a stem protruding from an aerosol container, and an actuator fitted to the stem, wherein the aerosol container includes a plurality of partitioned housing spaces, an inflow port corresponding to the housing space, and one or more valve units in which a sealing member opening and closing the inflow port is provided for each inflow port;

at least one among the plurality of housing spaces is a foamable liquid housing section that houses contents including a foamable liquid;

at least one other of the plurality of housing spaces is a foaming agent housing section that houses a foaming agent only composed of a liquefied gas only; and the foamable liquid discharged from the inflow port corresponding to the foamable liquid housing section and the foaming agent discharged from the inflow port corresponding to the foaming agent housing section are mixed in the actuator.

2. The aerosol product according to claim 1, wherein the inflow port corresponding to the foaming agent housing section is configured to discharge a liquid phase of the foaming agent from the foaming agent housing section.

3. The aerosol product according to claim 2, wherein the aerosol container has one container and one or more foamable liquid housing sections housed in the container; and the foaming agent housing section is configured by a space outside the foamable liquid housing section in the container.

4. The aerosol product according to claim 1, wherein the actuator has a fitting portion fitted to the stem, a mixing section where materials discharged from the inflow ports are mixed, and a discharge port for discharging the mixed discharged materials.

* * * * *